United States Patent [19]

Löffler

[11] 4,297,768

[45] Nov. 3, 1981

[54] CARDING PLATE

[75] Inventor: Walter Löffler, Neubulach, Fed. Rep. of Germany

[73] Assignee: Hollingsworth GmbH, Neubulach, Fed. Rep. of Germany

[21] Appl. No.: 85,810

[22] Filed: Oct. 17, 1979

[30] Foreign Application Priority Data

Oct. 23, 1978 [DE] Fed. Rep. of Germany ..... 2846110

[51] Int. Cl.[3] ..... D01G 15/24; D01G 15/84

[52] U.S. Cl. ..... 19/113; 19/114

[58] Field of Search ..... 19/113, 114

[56] References Cited

U.S. PATENT DOCUMENTS

| | | | |
|---|---|---|---|
| 3,402,432 | 9/1968 | Kalwaites | 19/113 X |
| 3,604,062 | 9/1971 | Hollingsworth | 19/113 |
| 3,737,953 | 6/1973 | Bechtel | 19/113 |
| 3,936,911 | 2/1976 | Roberts | 19/113 |
| 4,074,392 | 2/1978 | Bechtel | 19/113 |

FOREIGN PATENT DOCUMENTS

| | | | |
|---|---|---|---|
| 2544517 | 4/1977 | Fed. Rep. of Germany | 19/113 |

*Primary Examiner*—Louis Rimrodt
*Attorney, Agent, or Firm*—Max Fogiel

[57] ABSTRACT

A carding plate comprising a base plate having a concave and cylindrically shaped supporting surface adapted to receive a thin metal plate, onto which a plurality of parallely arranged saw-tooth wire segments are fixed. The so formed sub-assembly is clampingly held on the supporting surface by clamping strips, which are designed to be screwed to the base plate such that they exert a pressure on opposite edges of the metal plate.

13 Claims, 2 Drawing Figures

CARDING PLATE

BACKGROUND OF THE INVENTION

This invention relates to a carding plate comprising a support provided with a supporting surface in the form of a hollow cylinder and sawtooth wire sections supported adjacent one another on this supporting surface as the card clothing.

In known carding plates, the sawtooth wire sections are directly applied and attached to the supporting surface by a special process. When the card clothing is worn out or damaged by external influences, the carding plate has to be reclothed in a special workshop because its construction does not allow the necessary repair work to be carried out in the spinning mill.

SUMMARY OF THE INVENTION

The object of the present invention is to provide a carding plate of the type referred to at the beginning which may readily be reclothed on site without any need for special skills.

According to the invention, this object is achieved in that the sawtooth wire sections are attached to a thin holding plate and in that the carding element formed by the sawtooth wire sections and the holding plate is secured to the supporting surface of the base plate. A carding element such as this is light in weight and may readily be replaced in situ. The worn carding element is not reclothed. A carding plate of this type also has the advantage that the card clothing may readily be replaced as and when required.

The thin holding plate is preferably preformed in accordance with the curvature of the supporting surface of the base plate.

The carding element is best clamped to the base plate along the edges lying transversely of the sawtooth wire sections using clamping strips which are designed to be screwed fast to two end faces adjoining the supporting surface substantially at right-angles and which, after they have been screwed down, exert a pressure on the edges of the carding element lying transversely of the sawtooth wire sections. In this way, the carding element with the holding plate is pressed into firm contact with the base plate.

According to another aspect of the invention, angle sections are arranged between the clamping strips and the base plate and engage over the edge surfaces of the carding element. Where they are covered by the angle sections, the sawtooth wire sections are preferably free from sawteeth. Alternatively, however, the base plate may be formed at its two opposite end faces with recesses into which the particular flange of the angle section fits.

In one embodiment, the recesses are shallower than the angle sections are thick. Accordingly, the angle sections are clamped fast when the clamping strips are screwed down.

Alternatively, however, the recesses may also have a depth at least corresponding to the thickness of the angle sections, the clamping strips in this case being designed to receive tightening screws for firmly clamping the angle sections.

In a further development of this embodiment, the base plate comprises depressions in alignment with the tightening screws so that, after clamping down, the angle sections may still be shifted and are only fixed in position by the tightening screws.

The sawtooth wire sections may be attached to the holding plate by bonding.

BRIEF DESCRIPTION OF THE DRAWINGS

One embodiment of the invention is described by way of example in the following with reference to the accompanying diagrammatic drawings, wherein.

DESCRIPTION OF THE PREFERRED EMBODIMENTS

Figure 1:
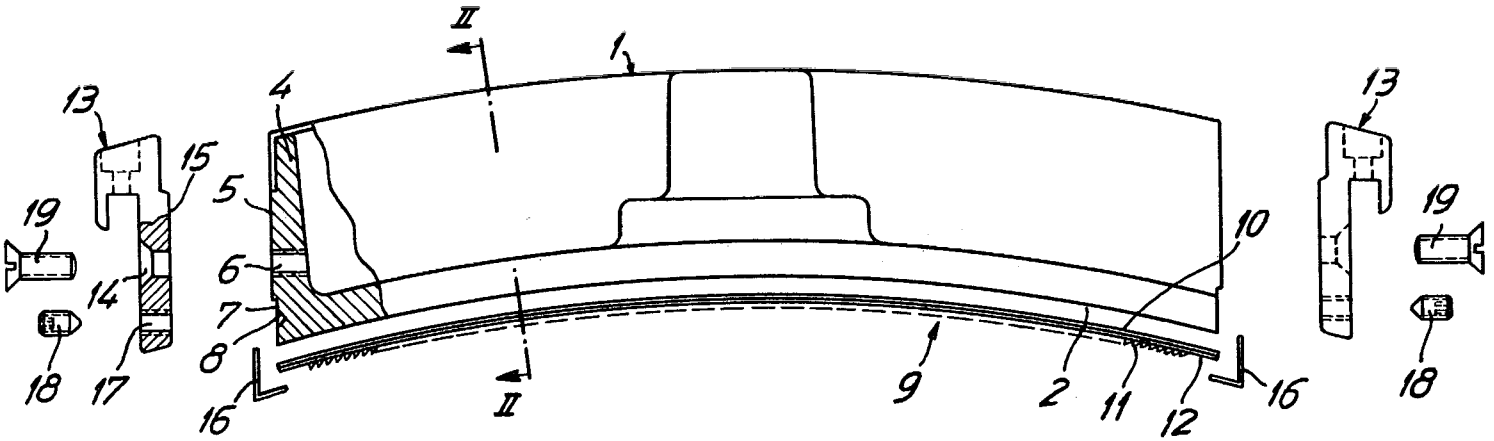
FIG. 1 is an exploded view, partly in section, of a carding plate.
Figure 2:
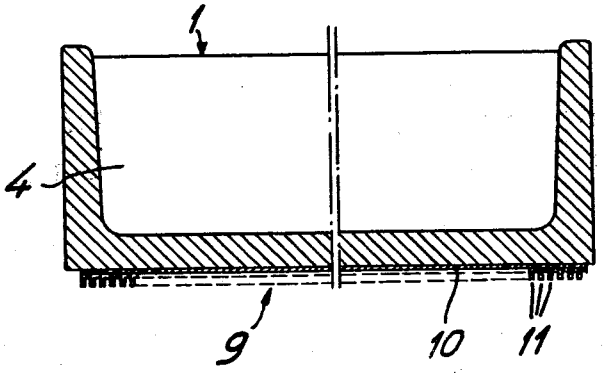
FIG. 2 is a section through a finished carding plate.

The carding plate shown in the drawings comprises a base plate 1 in the form of an aluminium recasting of which one surface 2 is in the shape of a hollow cylinder and forms a supporting surface 2. The straight edges 3 of this supporting surface are adjoined by end flanges 4 of which the outwardly directed surfaces 5 run parallel to one another. The end flanges comprises a series of bores 6 whose function will be described hereinafter. Adjoining each straight edge 3 there is a rectangular recess 7 on the base surface of which, running parallel to the end faces 5, a number of conical depressions 8 are arranged at intervals from one another.

The carding plate further comprises a carding element 9 which consists of a thin steel holding plate 10 and a number of sawtooth wire sections 11 secured closely adjacent one another thereto. The holding plate 10 is cylindrically curved with a curvature corresponding to the curvature of the end face 2. The sawtooth wire sections 11 are bonded or otherwise secured at their bases to the holding plate 10 and are free from teeth at their ends 12.

The carding plate further comprises two clamping strips 13 which are formed with a number of bores 14 aligning with the bores 6 in the base plate 1. Guided through the bores 14 are screws by which the clamping strips 13 are screwed fast to the end flanges 4. The size of the clamping strips is such that their flat surface 15 which comes into contact with the end face 5 of the end flanges 4 covers the recesses 7.

The carding plate further comprises two angle sections 16 each with two flanges which form an angle of slightly less than 90° with one another and of which the length substantially corresponds to the length of the straight edges 3. The dimensions of the angle sections are such that they fit into the recess 7 and, after installation, engage over a toothless end region of the carding element 9. At points situated over the recess 7, each clamping strip 13 is provided with a number of screwthreaded bores 17 which, when the clamping strips 13 are screwed down, align with associated depressions 8 in the base plate. Screwthreaded pins 18 fit into the screwthreaded bores 17 for immovably securing the angle sections 16.

For assembling the individual components, the clamping strips 13 are loosely screwed to the end flanges 4, the carding element is placed on the supporting surface 2, after which one flange of the angle sections 16 is placed over the end regions 12 whilst the other flange is inserted into the recess 7. The screwthreaded pins 18 are then tightened, thus fixing the angle sections 16. Thereafter the clamping strips 13 are clamped down by further tightening of the screws 19 inserted through the bores 14, exerting a pressure on the front edges 20 of the carding element 9 through the angle sections 16 so that the carding element 9 is brought into firm surface contact with the supporting surface 2.

Alternatively, the angle sections 16 may even have a thickness exceeding the depth of the recess 7, in which case the screwthreaded pins 18 are not absolutely essential because the angle sections 16 are clamped fast when the screws 19 are tightened.

I claim:

1. A carding plate comprising: a support with a base plate and a concave supporting surface forming part of a hollow cylinder; sawtooth wire sections supported adjacent one another on said supporting surface as the card clothing; a substantially thin flexible holding plate attached to said sawtooth wire sections; a carding element formed by said sawtooth wire sections and said holding plate and being secured to said supporting surface of said base plate; said holding plate being held in intimate contact with said base plate by exerting pressure on opposite edges of said flexible holding plate, said supporting surface having a cylindrical curvature causing pressure exerted in a circumferential direction of said holding plate to generate a reactive force in a radial direction between said supporting surface and said holding plate.

2. A carding plate as claimed in claim 1, wherein said holding plate is preformed in accordance with the curvature of said supporting surface of said base plate.

3. A carding plate as claimed in claim 1, wherein said carding element is clamped to said base plate along edges lying transversely of the sawtooth wire sections.

4. A carding plate as claimed in claim 3, wherein said carding element is clamped by clamping strips screwed fast to two end faces adjoining said supporting surface substantially at right-angles, said clamping strips after having been screwed down applying a pressure on edges of said carding element lying transversely of said sawtooth wire sections.

5. A carding plate as claimed in claim 4, including angle sections arranged between said clamping strips and said base plate and engaging over edge surfaces of said carding element.

6. A carding plate as claimed in claim 5, wherein sawtooth wire sections covered by the angle profiles are free from sawteeth.

7. A carding plate as claimed in claim 5, wherein said base plate has two opposite end faces formed with recesses into which a predetermined flange of an angle section fits.

8. A carding plate as claimed in claim 7, wherein said recesses are shallower than the angle sections are thick.

9. A carding plate as claimed in claim 7, wherein said recesses have a depth at least corresponding to the thickness of the angle sections, said clamping strips receiving tightening screws for firmly clamping the angle sections.

10. A carding plate as claimed in claim 9, wherein said base plate has depressions in alignment with said tightening screws.

11. A carding plate as claimed in claim 1, wherein said holding plate is made of steel.

12. A carding plate as claimed in claim 1, wherein said sawtooth wire sections are attached to said holding plate by bonding.

13. A carding plate as defined in claim 1, wherein said holding plate is preformed in accordance with the curvature of said supporting surface of said base plate; said carding element being clamped to said base plate along edges lying transversely of the sawtooth wire sections; said carding element being clamped by clamping strips screwed fast to two end faces adjoining said supporting surface substantially at right-angles, said clamping strips after having been screwed down applying a pressure on edges of said carding element lying transversely of said sawtooth wire sections; angle sections arranged between said clamping strips and said base plate and engaging over edge surfaces of said carding element; sawtooth wire sections covered by the angle profiles being free from sawteeth; said base plate have two opposite end faces formed with recesses into which a predetermined flange of an angle section fits; said recesses having a depth at least corresponding to the thickness of the angle sections, said clamping strips receiving tightening screws for firmly clamping the angle sections; said base plate having depressions in alignment with said tightening screws; said holding plate being made of steel; said sawtooth wire sections being attached to said holding plate by bonding.

* * * * *